US010285494B1

(12) United States Patent
Lho

(10) Patent No.: US 10,285,494 B1
(45) Date of Patent: May 14, 2019

(54) FLUID DISPENSER AND APPLICATOR

(71) Applicant: Helen Lho, Beverly Hills, CA (US)

(72) Inventor: Helen Lho, Beverly Hills, CA (US)

( * ) Notice: Subject to any disclaimer, the term of this patent is extended or adjusted under 35 U.S.C. 154(b) by 0 days.

(21) Appl. No.: 15/881,137

(22) Filed: Jan. 26, 2018

(51) Int. Cl.
*A46B 11/00* (2006.01)

(52) U.S. Cl.
CPC ..... *A46B 11/0041* (2013.01); *A46B 11/002* (2013.01); *A46B 11/0065* (2013.01)

(58) Field of Classification Search
CPC . A46B 11/0041; A46B 11/001; A46B 11/002; A46B 11/0051; A46B 11/0055; A46B 11/0058; A46B 11/0065; B05C 17/005; B05C 17/00569; B05C 17/00583; A61H 7/003; A61H 7/005
See application file for complete search history.

(56) References Cited

U.S. PATENT DOCUMENTS 2,162,907 A * 6/1939 Bambach ..... A46B 11/0027 15/188
2,260,100 A * 10/1941 Deitrich ..... B65D 47/42 222/490
3,256,894 A * 6/1966 Sherman ..... A46B 11/0055 222/209
4,139,124 A * 2/1979 Ferrante ..... B65D 83/0094 222/110
4,973,183 A * 11/1990 Shevick ..... A47K 5/1201 222/453

OTHER PUBLICATIONS

Amazon.com—KitchenAid Soap Dispensing Palm Brush, Aqua Sky, <https://www.amazon.com/KitchenAid-Soap-Dispensing-Palm-Brush/dp/B01FTVFISI?th=1>, Apr. 26, 2018 (8 pages).
Amazon.com—OXO Good Grips Soap Dispensing Palm Brush, <https://www.amazon.com/OXO-Good-Grips-Dispensing-Brush/dp/B00004OCLK/ref=sr_1_3?ie=UTF8&qid=1524261335&sr=8-3&keywords=oxo+soap+dispensing+palm+brush>, Apr. 26, 2018 (9 pages).
Amazon.com—Farberware Soap Dispensing Palm Brush, Black, <https://www.amazon.com/KitchenAid-Soap-Dispensing-Palm-Brush/dp/B01FTVFISI?th=1>, Apr. 26, 2018 (10 pages).

* cited by examiner

*Primary Examiner* — David J Walczak
(74) *Attorney, Agent, or Firm* — Loeb & Loeb LLP

(57) ABSTRACT

A fluid dispenser comprising a shell including a handle portion and an applicator portion opposite the handle portion. The fluid dispenser includes a handle connected to the handle portion of the shell, and an applicator connected to the applicator portion of the shell. The applicator includes a base portion, a plurality of nodules extending from the base portion away from the handle portion of the shell, and at least one dispensing orifice. An interior cavity is formed between the applicator and the shell, where the at least one dispensing orifice provides selective fluid communication into the interior cavity through the applicator.

19 Claims, 13 Drawing Sheets

FLUID DISPENSER AND APPLICATOR

BACKGROUND

Many people suffer from various ailments that may benefit from massages, shampoos, or the application of other oils and fluids. Various tools have been used by treatment professionals or individual users to treat these ailments.

SUMMARY

In an embodiment, the disclosure describes a fluid dispenser comprising a shell including a handle portion and an applicator portion opposite the handle portion. The fluid dispenser includes a handle connected to the handle portion of the shell, and an applicator connected to the applicator portion of the shell. The applicator includes a base portion, a plurality of nodules extending from the base portion away from the handle portion of the shell, and at least one dispensing orifice. An interior cavity is formed between the applicator and the shell, where the at least one dispensing orifice provides selective fluid communication into the interior cavity through the applicator.

In another embodiment, the disclosure describes a fluid dispenser comprising a shell including a handle portion and an applicator portion opposite the handle portion. A bore is formed in the handle portion and an applicator orifice is formed in the applicator portion. The dispenser includes an applicator connected to the applicator portion of the shell so as to occlude the applicator orifice. The applicator includes a base portion, a plurality of nodules extending from the base portion away from the handle portion, and at least one dispensing orifice formed through the applicator. The dispenser includes a handle removably connected to the handle portion of the shell so as to occlude the bore. The dispenser also includes an interior cavity formed between the shell and the applicator. The at least one dispensing orifice is configured to provide selective fluid communication through the applicator from the interior cavity.

In another embodiment, the disclosure describes a fluid dispenser including a shell with a handle portion and an applicator portion opposite the handle portion. A bore is formed in the handle portion by interior walls and an applicator orifice being formed in the applicator portion. The dispenser includes an applicator connected to the applicator portion of the shell so as to occlude the applicator orifice. The applicator includes a base portion, a plurality of nodules extending from the base portion away from the handle portion, and at least one dispensing orifice formed through the applicator and in fluid communication with the bore. The dispenser includes a handle removably connected to the handle portion of the shell so as to occlude the bore in a closed position and allow access to the bore in an open position. In one embodiment, the dispenser also includes a cartridge configured to be received within the bore through the handle portion of the shell when the handle is in the open position. In another embodiment, the base portion may be in hinged, threaded or snap communication with the handle portion and the cartridge may be received into the bore through the opening formed when the base portion is hinged open. A fluid included within the cartridge is in fluid communication with the at least one dispensing orifice when the cartridge is within the bore.

BRIEF DESCRIPTION OF THE DRAWINGS

The invention may be better understood by reference to the detailed description when considered in connection with the accompanying drawings. The components in the figures are not necessarily to scale, emphasis instead being placed upon illustrating the principles of the invention. In the figures, like reference numerals designate corresponding parts throughout the different views.

Figure 1:
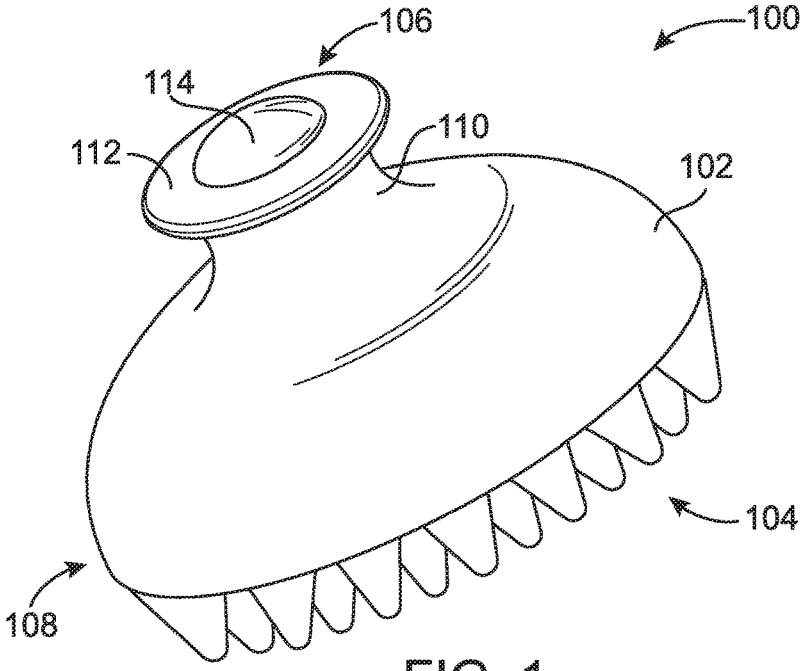
FIG. 1 is a perspective view of an embodiment of a fluid dispenser and applicator in accordance with the disclosure.

Persons of ordinary skill in the art will appreciate that elements in the figures are illustrated for simplicity and clarity so not all connections and options have been shown to avoid obscuring the inventive aspects. For example, common but well-understood elements that are useful or necessary in a commercially feasible embodiment are not often depicted in order to facilitate a less obstructed view of these various embodiments of the present disclosure. It will be further appreciated that certain actions and/or steps may be described or depicted in a particular order of occurrence while those skilled in the art will understand that such specificity with respect to sequence is not actually required. It will also be understood that the terms and expressions used herein are to be defined with respect to their corresponding respective areas of inquiry and study except where specific meanings have otherwise been set forth herein.

DETAILED DESCRIPTION

The present invention now will be described more fully hereinafter with reference to the accompanying drawings, which form a part hereof, and which show, by way of illustration, specific exemplary embodiments by which the invention may be practiced. This invention may, however, be embodied in many different forms and should not be construed as limited to the embodiments set forth herein; rather, these embodiments are provided so that this disclosure will be thorough and complete, and will fully convey the scope of the invention to those skilled in the art. Among other things, the present invention may be embodied as methods or devices. The following detailed description is, therefore, not to be taken in a limiting sense.

Throughout the specification and claims, the following terms take the meanings explicitly associated herein, unless the context clearly dictates otherwise. The phrase "in one embodiment" as used herein does not necessarily refer to the same embodiment, although it may. Furthermore, the phrase "in another embodiment" as used herein does not necessarily refer to a different embodiment, although it may. Thus, as described below, various embodiments of the invention may be readily combined, without departing from the scope or spirit of the invention.

In addition, as used herein, the term "or" is an inclusive "or" operator, and is equivalent to the term "and/or," unless the context clearly dictates otherwise. The term "based on" is not exclusive and allows for being based on additional factors not described, unless the context clearly dictates otherwise. In addition, throughout the specification, the meaning of "a," "an," and "the" include plural references. The meaning of "in" includes "in" and includes plural references. The meaning of "in" includes "in" and "on."

The disclosure generally related to a fluid dispenser, applicator, and massaging device. The device may be hold any of various types of fluid to be applied to a user's scalp, skin, etc. For example, in some embodiments, the device may be filled with shampoo or another hair product. In such embodiments the fluid may be applied while the user is bathing, or can be applied by a hair stylist or other hair professional. In other embodiments, the fluid may be a massage oil, moisturizing lotion or other appropriate fluid for the given application. In yet another embodiment, the fluid may be used to assist in hair growth or may be used to remove hair.

The device may include an applicator portion comprising a plurality of resilient nodules or prongs. During application, the nodules may act to massage the user's scalp or other areas, enhancing the user experience of applying the fluid and stimulating blood flow to the massaged areas. In some embodiments, the device may be refillable, and may be lockable such that fluid will not dispense accidentally during travel or otherwise. In some embodiments, the applicator portion may be removable and replaceable such that different application portions may be used or an application portion may be replaced when a new or improved application portion is desired.

Figure 2:
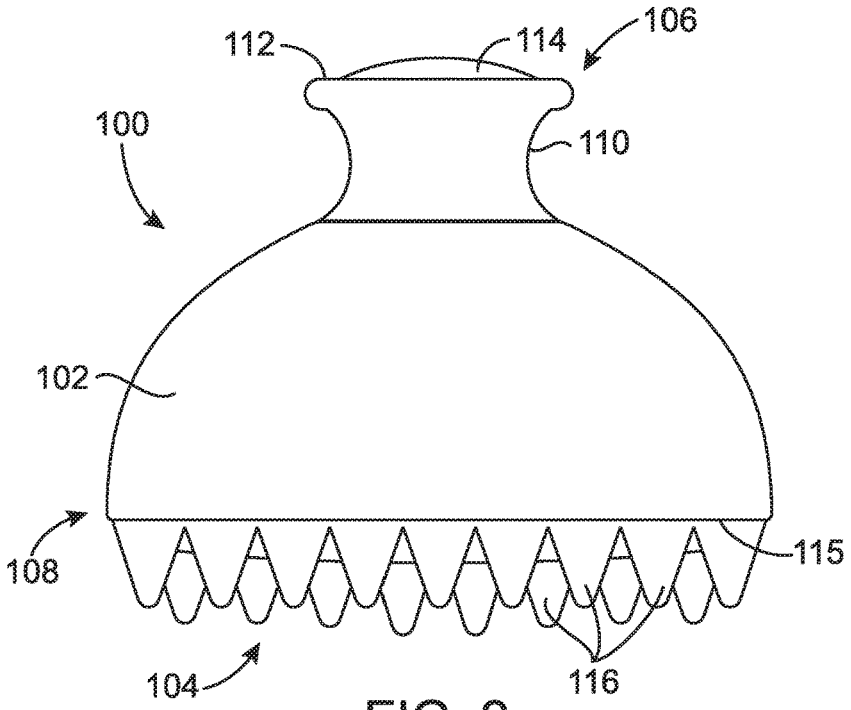
FIG. 2 is a front view of the fluid dispenser and applicator of FIG. 1.
Figure 3:
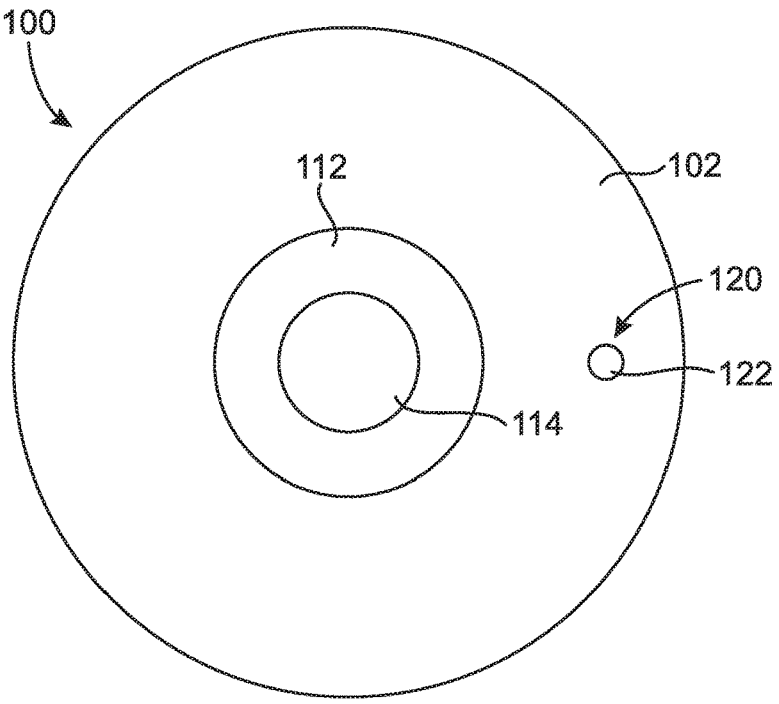
FIG. 3 is a top view of the fluid dispenser applicator of FIG. 1.

Referring now to the drawings, FIGS. 1-3 show an embodiment of a device 100 in accordance with the disclosure. The device 100 includes a shell 102 and an applicator 104. In the embodiment illustrated in FIGS. 1-3, the shell 102 is a generally hemispherical in shape, but other shapes are contemplated such as ovular, egg-shaped, or any other suitable shape. The shell 102 may have a handle portion 106 and an applicator portion 108 that may connect to the applicator 104. The handle portion 106 may include a handle 110 extending from the shell 102 so as to provide grip to the user during use. The handle 110 may extend generally from the center of the shell 102, but may alternatively extend from an area of the shell nearer to edges of the shell. It is contemplated that, in some embodiments, the handle 110 may extend from the shell 102 in a location determined to be ergonomically advantageous to a user. The handle 110 may be integral with the shell 102 in some embodiments, or may be a separate part in other embodiments.

In some embodiments, the handle 110 may have a top portion 112 that includes a dispensing trigger 114. In such embodiments, the dispensing trigger 114 may be pressed or otherwise engaged to activate the dispensing of fluid from the within the interior of the shell 102 and out of the applicator 104. Some embodiments may not include a dispensing trigger at all, and instead dispense fluid via gravity or another triggering mechanism.

As shown in FIG. 3, an access orifice 120 may be formed into the shell 102 to provide fluid communication into the shell's hollow interior. The access orifice 120 may be selectively occluded by a plug 122, which, in some embodiments, a user may remove to refill the device 100 with fluid.

Figure 4:
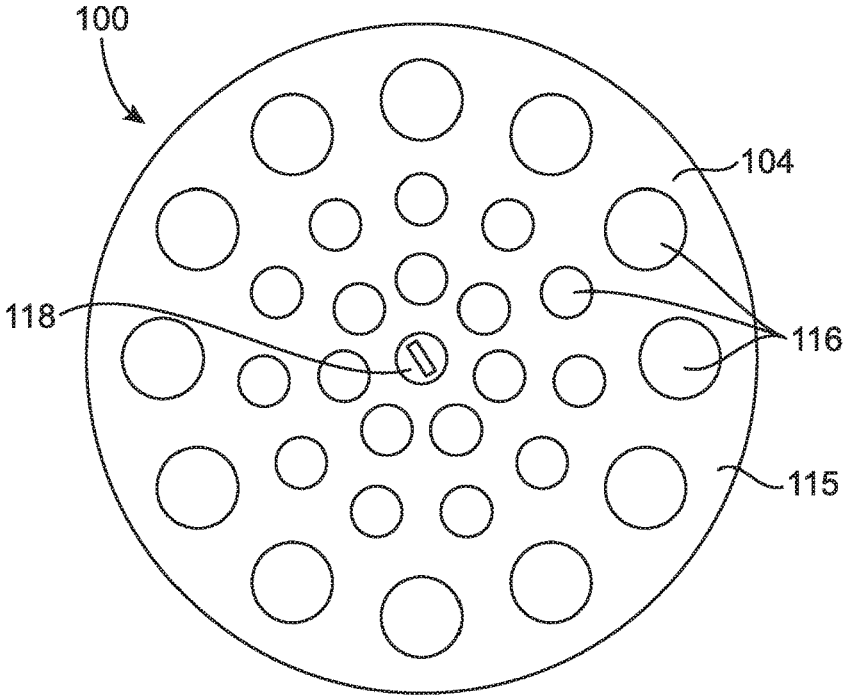
FIG. 4 is a bottom view of the fluid dispenser and applicator of FIG. 1.

The applicator 104 may be made from any suitable material, such as rubber, rubber polymer, synthetic rubber, or any resilient, soft, flexible, or rigid material for massaging. As shown in FIG. 4, the applicator 104 may include a base portion 115 and a plurality of nodules 116 extending from the base portion away from the shell 102. The base portion 115 may be connected to the applicator portion 108 of the shell 102 so that that nodules 116 are opposite the handle portion 106 of the shell. In some embodiments, the nodules 116 are integral with the base portion 115. In other embodiments, the nodules are otherwise connected to the base portion 115 using an adhesive or another fastening mechanism. Any suitable configuration and shape of nodules 116 is contemplated herein. For example, the nodules 116 may have relatively dull or pointed ends depending on the particular application. Additionally, it is contemplated that the nodules 116 may all be the same size and extend the same distance from the base portion 115, or may vary in size and/or extension from the base portion.

As shown in FIG. 4, the applicator 104 may include at least one dispensing orifice 118 forming selective fluid communication into the interior of the device 100 and through which fluid held within the device 100 may be dispensed. The illustrated embodiment includes a single dispensing orifice 118 disposed generally in the center of a generally circularly shaped applicator 104, but other embodiments may include multiple orifices disposed in a variety of locations. Further, in the illustrated embodiment, the dispensing orifice 118 may be formed into the base portion 115 of the applicator 104, but it is contemplated that, in some embodiments, the dispensing orifice 118 may be disposed on one or more nodules also or instead. The dispensing orifice 118 may be a one-way check valve in some embodiments, allowing fluid within the device 100 to exit through the applicator 104, but limit or prevent air or other fluid from outside the dispenser from entering. Additionally, in some embodiments, the dispensing orifice 118 may be lockable so as to prevent unintentional dispensing of the fluid. It is contemplated that in other embodiments, the dispensing orifice 118 may be a selectively closable orifice that may be occluded by turning a plate disposed on the base portion 115, by removing a plug from the dispensing orifice 118, or any other suitable selective opening mechanism familiar to those skilled in the art.

Figure 5:
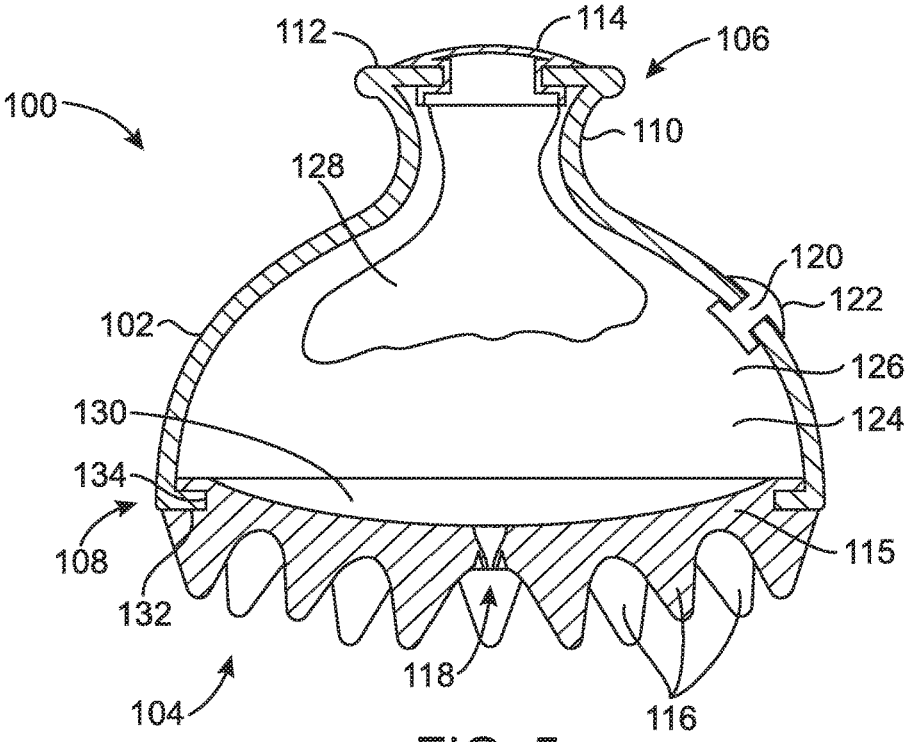
FIG. 5 is a cross-sectional front view of the fluid dispenser and applicator of FIG. 1.

FIG. 5 shows a cross-sectional view of an embodiment of the device 100. The shell 102 may be generally hollow, forming an interior cavity 124 between the shell and base portion 115 of the applicator 104. The applicator portion 108 of the shell 102 may form an applicator orifice 130 that is covered by the applicator 104. In some embodiments, the base portion 115 of the applicator 104 may be connected to the applicator portion 108 of the shell 102 so as to close off the applicator orifice 130. In some embodiments, the applicator portion 108 of the shell 102 may include a rim 132 extending inward from the exterior of the shell. In such embodiments, the base portion 115 of the applicator 104 may include a connecting channel 134 formed around most or the entirety of the outer circumference of the base portion 115. In some embodiments, the rim 132 of the shell 102 may engage with the connecting channel 134 to connect the applicator 104 to the applicator portion 108 of the shell 102 and form a fluid seal between them. In some embodiments, the shell 102 and the applicator 104 may be also be connected using adhesive or any other suitable mechanical or other fasteners.

The interior cavity 124 may hold a dispensing fluid 126 that is to be dispensed from the device 100. In some embodiments, the device 100 may include an inflatable pouch 128 that may be operatively connected to the dispensing trigger 114. The inflatable pouch 128 may be made from a non-rigid, fluid impermeable material that may change in volume based on fluid pressure within and outside of the pouch. In such embodiments, upon activation of the dispensing trigger 114, air from the atmosphere may be introduced into the inflatable pouch 128, causing the pouch to inflate and increase in volume. In such embodiments, the dispensing trigger 114 may include at least one valve that operates to pump air into the pouch upon being compressed by a user. As the pouch 128 increases in volume from the introduction of air, the dispensing fluid 126 may be forced out of the interior cavity 124 through the dispensing orifice 118 in the applicator 104.

In some embodiments, the applicator 104 may be generally bowed or angled such that fluid 126 resting against the base portion 115 of the applicator 104 within the interior cavity 124 may, with the help of gravity or other pressure, flow toward the dispensing orifice 118 to minimize wasted fluid. When the interior cavity 124 is empty or if a user would like to refill the interior cavity, the plug 122 may be removed. Additional fluid 126 may be introduced through the access orifice 120. Additionally, in some embodiments, the pressurized air within the pouch 128 may be exhausted out of valves (not shown) in the shell 102 or the dispensing trigger 114.

It is contemplated that, in some embodiments, the device 100 does not include an inflatable pouch 128 at all. Instead, the dispensing trigger 114 acts as a pump that may increase the pressure in the interior cavity 124 directly, causing the fluid 126 to flow out of the dispensing orifice 118 once the pressure his high enough. In such embodiments, the pressure within the interior cavity 124 may be exhausted through the access orifice 120 when the plug 122 is removed. It is contemplated that, in some embodiments, the dispensing trigger 114 may disposed on the shell 102 at a location other than on the handle.

Connecting Channel

Figure 6:
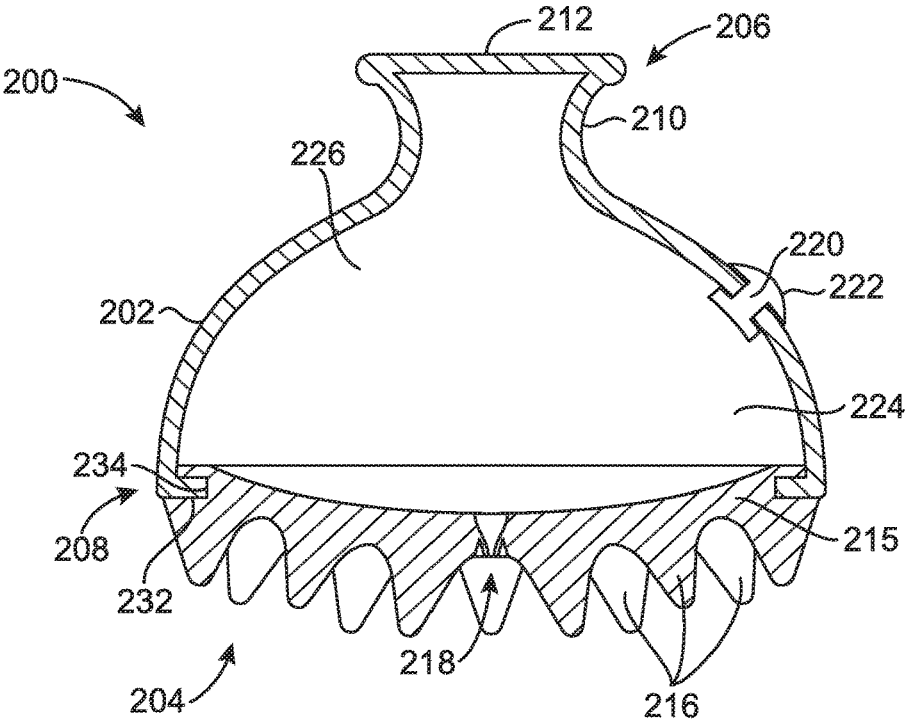
FIG. 6 is a cross-sectional front view of another embodiment of a fluid dispenser and applicator in accordance with the disclosure.

FIG. 6 shows a cross-sectional view of another embodiment of a fluid dispensing, applicator, and massaging device 200. Similar to the device 100 shown in FIGS. 1-5, the device 200 may include a shell 202, an applicator 204, a handle portion 206, an applicator portion 208 opposite the handle portion, and handle 210 with a top portion 212. Also like device 100, the applicator 204 may include a base portion 215, a plurality of nodules 216, and one or more dispensing orifices 218 that may include one-way check valves or other selectably openable orifices.

In some embodiments, the applicator portion 208 of the shell 202 may include a rim 232 extending inward from the exterior of the shell. In such embodiments, the base portion 215 of the applicator 204 may include a connecting channel 234 formed around most or the entirety of the outer circumference of the base portion 215. In some embodiments, the rim 232 of the shell 202 may engage with the connecting channel 234 to connect the applicator 204 to the applicator portion 208 of the shell 202 and form a fluid seal between them. In some embodiments, the shell 202 and the applicator 204 may be also be connected using adhesive or any other suitable mechanical or other fasteners. Additionally, an access orifice 220 may be formed into the shell 202 to provide fluid communication into the shell's hollow interior. The access orifice 220 may be selectively occluded by a plug 222, which, in some embodiments, a user may remove to refill the device 200 with fluid.

The shell 202 be generally hollow, forming an interior cavity 224 between the shell and base portion 215 of the applicator 204. The applicator portion 208 of the shell 202 may form an applicator orifice 230 that is covered by the applicator 204. In some embodiments, a fluid 226 may fill or partially fill the interior cavity 224. During use, the applicator 104 may be pressed against a user's scalp, causing the pressure within the interior cavity 224 to increase. When the pressure in the interior cavity 224 becomes high enough, the fluid 226 may overcome the dispenser orifice 218 and flow out of the device 200. Additional fluid may be added to the interior cavity 224 by removing the plug 222 and introducing fluid through the access orifice 220.

Threaded Handle Portion

Figure 7:
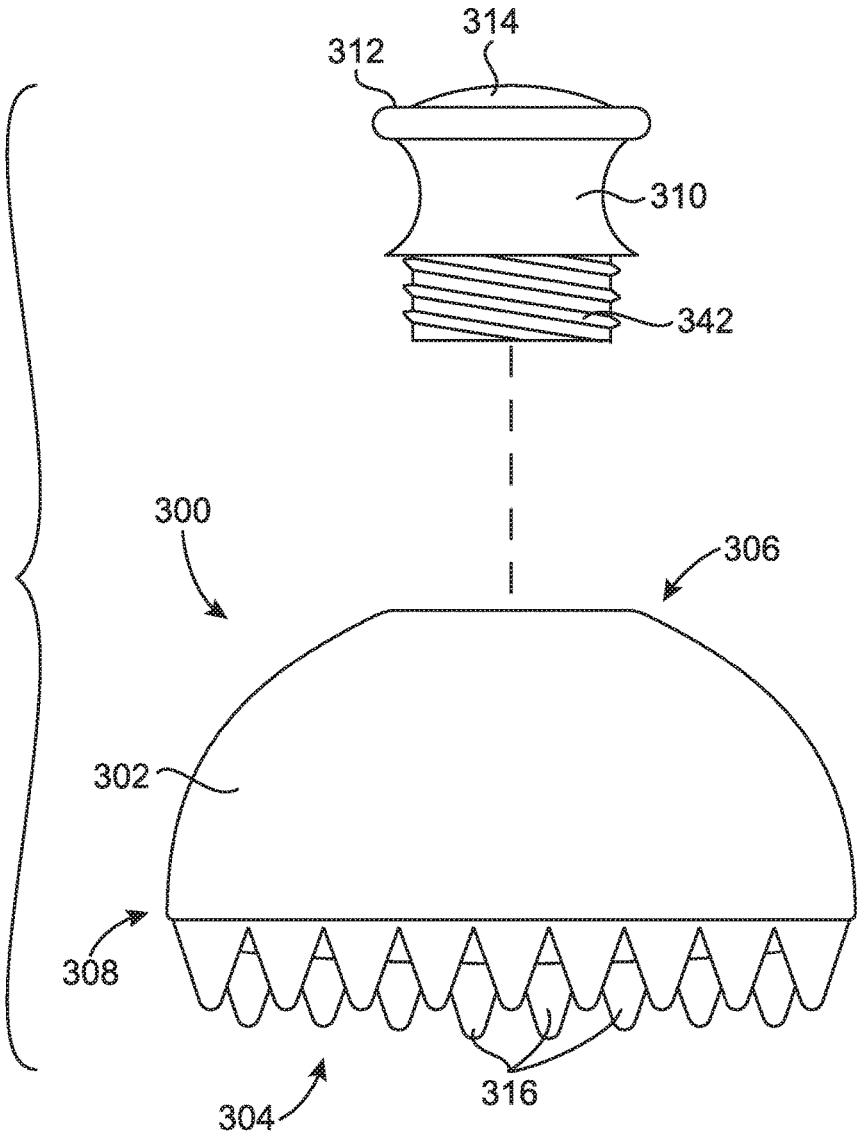
FIG. 7 is an exploded front view of another embodiment of a fluid dispenser and applicator in accordance with the disclosure.
Figure 8:
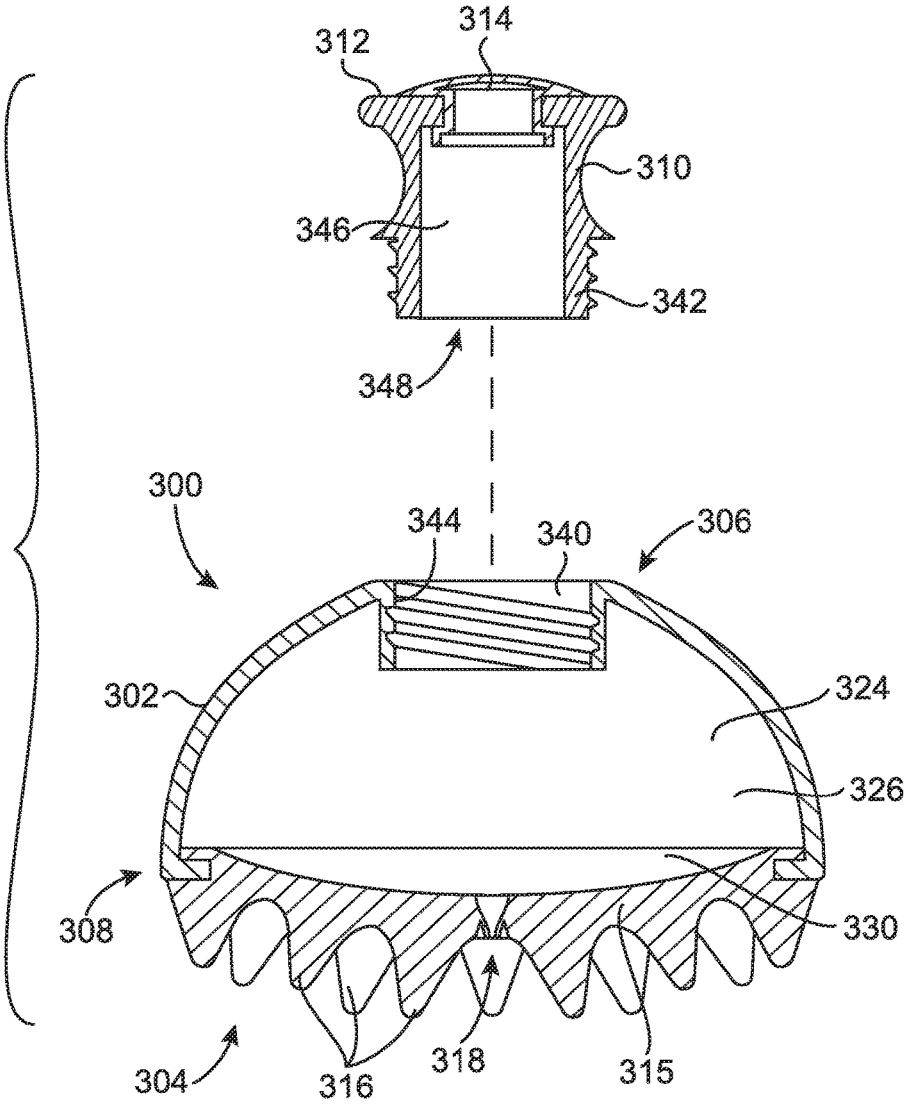
FIG. 8 is an exploded cross-sectional front view of the fluid dispenser and applicator of FIG. 7.

FIGS. 7 and 8 show another embodiment of a fluid dispenser, applicator, and massaging device 300. The device 300 may include a shell 302 and an applicator 304. In the embodiment illustrated in FIGS. 7 and 8, the shell 302 is a generally hemispherical in shape, but other shapes are contemplated such as ovular, egg-shaped, or any other suitable shape. The shell 302 may have a handle portion 306 and an applicator portion 308 that may connect to the applicator 304. The handle portion 306 may include a handle 410 extending from the shell 302 so as to provide grip to the user during use. The handle 310 may extend generally from the center of the shell 302, but may alternatively extend from an area of the shell nearer to edges of the shell. It is contemplated that, in some embodiments, the handle 310 may extend from the shell 302 in a location determined to be ergonomically advantageous to a user.

In some embodiments, a handle bore 340 may be formed in the handle portion 306 of the shell 302. A mating portion 342 of the handle 310 may engage with the handle bore 340 to connect the handle 310 to the shell 302. Both the mating portion 342 of the handle 310 and the interior walls 344 of the handle bore 340 may be threaded to secure the handle within the handle bore. In some embodiments, the handle 310 may include a handle cavity 346 with a handle cavity opening 348 opposite a top portion 312 of the handle. The top portion 312 of the handle 310 may include a dispensing trigger 314. In such embodiments, the dispensing trigger 314 may be pressed or otherwise engaged to activate the dispensing of fluid from the within the interior of the shell 302 and out of the applicator 304. Some embodiments may not include a dispensing trigger at all, and instead dispense fluid via gravity or another triggering mechanism.

The applicator 304 may be made from any suitable material, such as rubber, rubber polymer, synthetic rubber, or any resilient, soft, flexible, or rigid material for massaging. The applicator 304 may include a base portion 315 and a plurality of nodules 316 extending from the base portion away from the shell 302. The base portion 315 may be connected to the applicator portion 308 of the shell 302 so that that nodules 316 are opposite the handle portion 306 of the shell. In some embodiments, the nodules 316 are integral with the base portion 315. In other embodiments, the nodules 316 are otherwise connected to the base portion 315 using an adhesive or another fastening mechanism. Any suitable configuration and shape of nodules 316 is contemplated herein. For example, the nodules 316 may have relatively dull or pointed ends depending on the particular application. Additionally, it is contemplated that the nodules 316 may all be the same size and extend the same distance from the base portion 315, or may vary in size and/or extension from the base portion.

The applicator 304 may include at least one dispensing orifice 318 forming selective fluid communication into the interior of the device 300 and through which fluid held within the device 300 may be dispensed. The illustrated embodiment includes a single dispensing orifice 318 disposed generally in the center of a generally circularly shaped applicator 304, but other embodiments may include multiple orifices disposed in a variety of locations. Further, in the illustrated embodiment, the dispensing orifice 318 may be formed into the base portion 315 of the applicator 304, but it is contemplated that, in some embodiments, the dispensing orifice 318 may be disposed on one or more nodules also or instead. The dispensing orifice 318 may be a one-way check valve in some embodiments, allowing fluid within the device 300 to exit through the applicator 304, but limit or prevent air or other fluid from outside the dispenser from entering. Additionally, in some embodiments, the dispensing orifice 318 may be lockable so as to prevent unintentional dispensing of the fluid. It is contemplated that in other embodiments, the dispensing orifice 318 may be a selectively closable orifice that may be occluded by turning a plate disposed on the base portion 315, by removing a plug from the dispensing orifice 318, or any other suitable selective opening mechanism familiar to those skilled in the art.

The shell 302 may be generally hollow, forming an interior cavity 324 between the shell and base portion 315 of the applicator 304. The applicator portion 308 of the shell 302 may form an applicator orifice 330 that is covered by the applicator 304. In some embodiments, the base portion 315 of the applicator 304 may be connected to the applicator portion 308 of the shell 302 so as to close off the applicator orifice 330. When the handle 310 is connected to the shell 302, the handle cavity 346 may fluidly communicate with the interior cavity 324 of the shell 302 to form a single cavity.

The interior cavity 324 may hold a dispensing fluid 326 that is to be dispensed from the device 300. In such embodiments, upon activation of the dispensing trigger 314, air from the atmosphere may be introduced into the interior cavity 324, causing the pressure within the interior cavity to increase. In such embodiments, the dispensing trigger 314 may include at least one valve that operates to pump air into the interior cavity 324 upon being compressed by a user. As the pressure within the interior cavity 324 increases from the introduction of air, the dispensing fluid 326 may be forced out of the interior cavity 324 through the dispensing orifice 318 in the applicator 304.

In some embodiments, the applicator 304 may be generally bowed or angled such that fluid 326 resting against the base portion 315 of the applicator 304 within the interior cavity 324 may, with the help of gravity or other pressure, flow toward the dispensing orifice 318 to minimize wasted fluid. When the interior cavity 324 is empty or if a user would like to refill the interior cavity, the handle 310 may be removed from the shell 302 and additional fluid may be introduced to the interior cavity 324 through the handle bore 340. Additionally, upon removing the handle 310 from the shell 302, the pressure within the interior cavity 324 may stabilize.

Handle Screw

Figure 9:
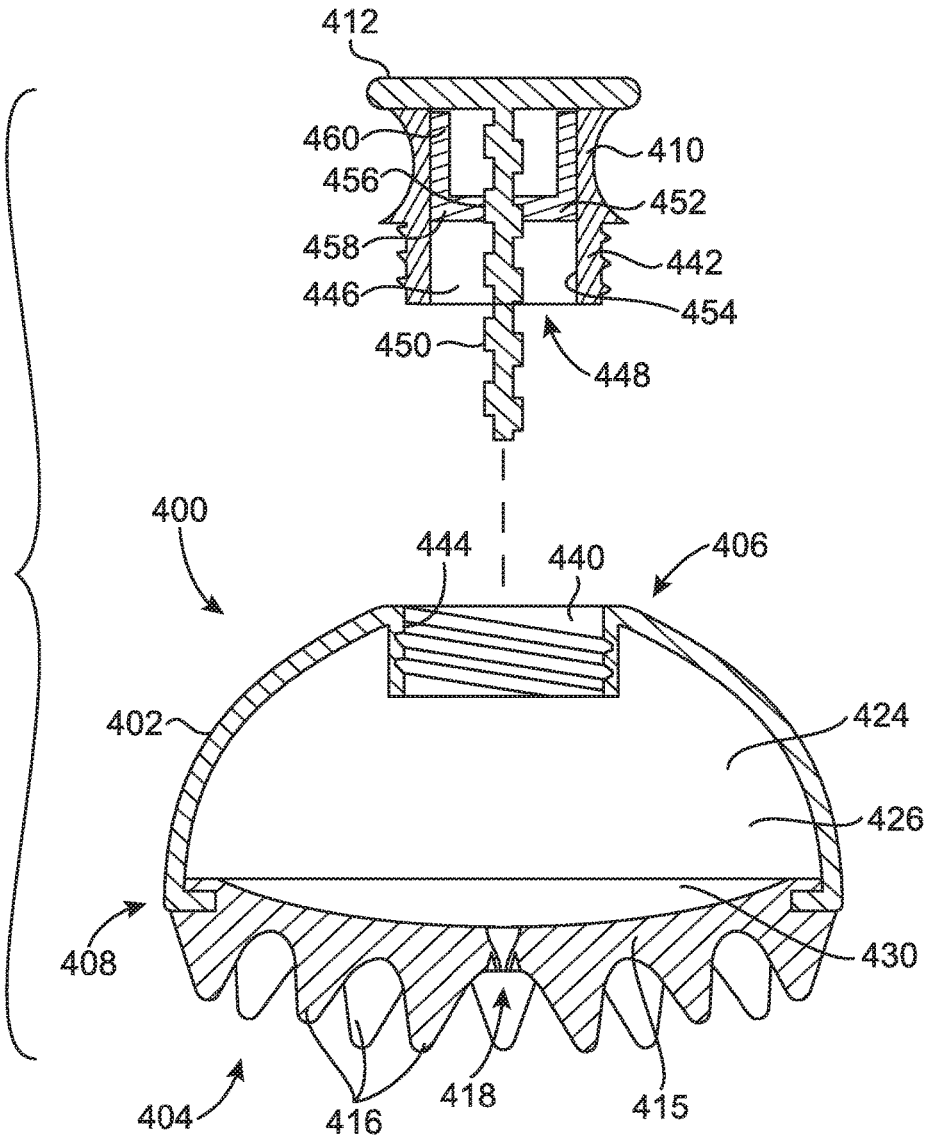
FIG. 9 is an exploded cross-sectional front view of another embodiment of a fluid dispenser and applicator in accordance with the disclosure.

FIG. 9 shows a cross-sectional view of another embodiment of a fluid dispenser, applicator, and massaging device 400. The device 400 may include a shell 402 and an applicator 404. In the embodiment illustrated in FIG. 9, the shell 402 is a generally hemispherical in shape, but other shapes are contemplated such as ovular, egg-shaped, or any other suitable shape. The shell 402 may have a handle portion 406 and an applicator portion 408 that may connect to the applicator 404. The handle portion 406 may include a handle 410 extending from the shell 402 so as to provide grip to the user during use. The handle 410 may extend generally from the center of the shell 402, but may alternatively extend from an area of the shell nearer to edges of the shell. It is contemplated that, in some embodiments, the handle 410 may extend from the shell 402 in a location determined to be ergonomically advantageous to a user.

In some embodiments, a handle bore 440 may be formed in the handle portion 406 of the shell 402. A mating portion 442 of the handle 410 may engage with the handle bore 440 to connect the handle 410 to the shell 402. Both the mating portion 442 of the handle 410 and the interior walls 444 of the handle bore 440 may be threaded to secure the handle within the handle bore. In some embodiments, the handle 410 may include a handle cavity 446 with a handle cavity opening 448 opposite a top portion 412 of the handle.

In some embodiments, the top portion 412 of the handle 410 may include a handle screw 450, which may both be rotatable with respect to the handle 410. The handle screw 450 may pass through the handle cavity 446 and be substantially centered within the handle 410. A handle piston 452 may be substantially cylindrically shaped and be slidably engaged with interior walls 454 of the handle 410. The handle piston 452 may include a base portion 458 and piston wall portion 460. The handle screw 450 may pass through a piston orifice 456 in the base portion 458 of the handle piston 452. In some embodiments, the handle screw 450 may be threaded such that the handle piston 452 may move vertically within the handle cavity 446 when the top portion 412 is rotated, thereby rotating the handle screw.

The applicator 404 may be made from any suitable material, such as rubber, rubber polymer, synthetic rubber, or any resilient, soft, flexible, or rigid material for massaging. The applicator 404 may include a base portion 415 and a plurality of nodules 416 extending from the base portion away from the shell 402. The base portion 415 may be connected to the applicator portion 408 of the shell 402 so that that nodules 416 are opposite the handle portion 406 of the shell. In some embodiments, the nodules 416 are integral with the base portion 415. In other embodiments, the nodules 416 are otherwise connected to the base portion 415 using an adhesive or another fastening mechanism. Any suitable configuration and shape of nodules 416 is contemplated herein. For example, the nodules 416 may have relatively dull or pointed ends depending on the particular application. Additionally, it is contemplated that the nodules 416 may all be the same size and extend the same distance from the base portion 415, or may vary in size and/or extension from the base portion.

The applicator 404 may include at least one dispensing orifice 418 forming selective fluid communication into the interior of the device 400 and through which fluid held within the device 400 may be dispensed. The illustrated embodiment includes a single dispensing orifice 418 disposed generally in the center of a generally circularly shaped applicator 404, but other embodiments may include multiple orifices disposed in a variety of locations. Further, in the illustrated embodiment, the dispensing orifice 418 may be formed into the base portion 415 of the applicator 404, but it is contemplated that, in some embodiments, the dispensing orifice 418 may be disposed on one or more nodules also or instead.

The shell 402 may be generally hollow, forming an interior cavity 424 between the shell and base portion 415 of the applicator 404. The applicator portion 408 of the shell 402 may form an applicator orifice 430 that is covered by the applicator 404. In some embodiments, the base portion 415 of the applicator 404 may be connected to the applicator portion 408 of the shell 402 so as to close off the applicator orifice 430. When the handle 410 is connected to the shell 402, the handle cavity 446 may fluidly communicate with the interior cavity 424 of the shell 402 to form a single cavity.

The interior cavity 424 may hold a dispensing fluid 426 that is to be dispensed from the device 400. In such embodiments, the top portion 412 of the handle 410 may be rotated, causing the handle piston 452 to move toward the applicator 404 and reducing the volume of the interior cavity 424. As the volume in the interior cavity 424 decreases, the pressure within the interior cavity may increase, forcing the dispensing fluid 426 out of the interior cavity 424 through the dispensing orifice 418 in the applicator 404. The piston wall portion 460 allows the base portion 458 to extend downward past the handle cavity opening 448, allowing additional fluid 426 to be expelled from the orifice 418.

In some embodiments, the top portion 412 of the handle 410 may include a ratchet system so as to prevent the top portion from involuntarily reversing rotation. In some embodiments, the applicator 404 may be generally bowed or angled such that fluid 426 resting against the base portion 415 of the applicator 404 within the interior cavity 424 may, with the help of gravity or other pressure, flow toward the dispensing orifice 418 to minimize wasted fluid. When the interior cavity 424 is empty or if a user would like to refill the interior cavity, the handle 410 may be removed from the shell 402 and additional fluid may be introduced to the interior cavity 424 through the handle bore 440.

Ratchet System

Figure 10:
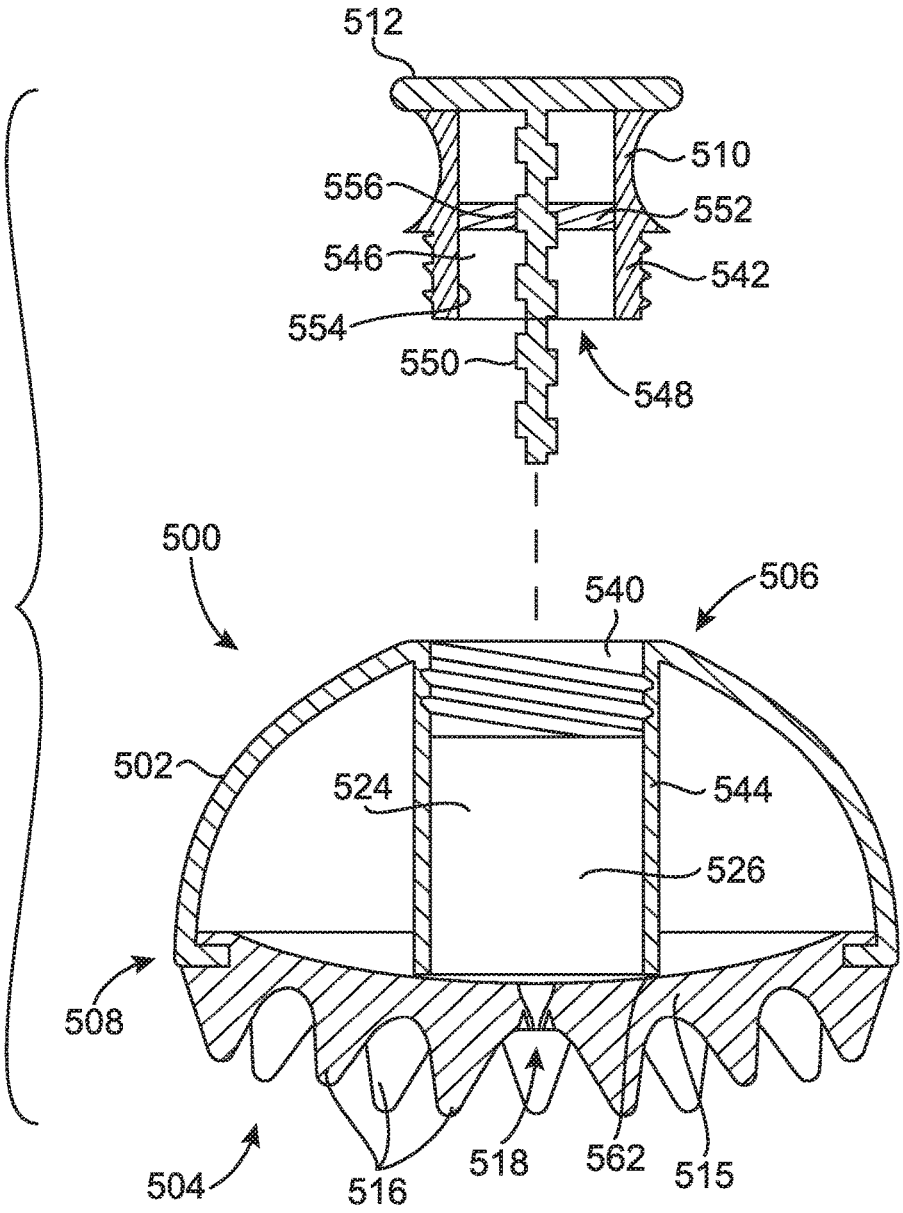
FIG. 10 is an exploded cross-sectional front view of another embodiment of a fluid dispenser and applicator in accordance with the disclosure.

FIG. 10 shows a cross-sectional view of another embodiment of a fluid dispenser, applicator, and massage device 500 that may be similar to the device 400 shown in FIG. 9. Particularly, the device 500 may also include a shell 502 with a handle portion 506 and an applicator portion 508, with a handle bore 540 formed into the handle portion 506 of the shell. The device 500 may also include an applicator 504 connected to the applicator portion 508 of the shell 502. The applicator 504 may include a plurality of nodules 516 and one or more dispensing orifices 518. The shell 502 of device 500 may also include interior walls 544 of the handle bore 540 extending substantially all the way to the base portion 515 of the applicator 504. The interior walls 544 may form an interior cavity 524 that may fluidly communicate with the dispensing orifice 518. In some embodiments, distal ends 562 of the interior walls 544 may be adhered or otherwise connected to the base portion 515 of the applicator 504 to create a substantially fluid impermeable seal.

A mating portion 542 of a handle 510 may engage with the handle bore 540 to connect the handle 510 to the shell 502. Both the mating portion 542 of the handle 510 and at least a portion of the interior walls 544 of the handle bore 540 may be threaded to secure the handle within the handle bore. In some embodiments, the handle 510 may include a handle cavity 546 with a handle cavity opening 548 opposite a top portion 512 of the handle. In some embodiments, the top portion 512 of the handle 510 may include a handle screw 550, both being rotatable with respect to the handle 510. The handle screw 550 may pass through the handle cavity 546 and be substantially centered within the handle 510. A handle piston 552 may be substantially cylindrically shaped and be slidably engaged with interior walls 554 of the handle 510. The handle screw 550 may pass through a piston orifice 556 in the handle piston 552. In some embodiments, the handle screw 550 may be threaded such that the handle piston 552 may move vertically within the handle cavity 546 when the top portion 512 is rotated, thereby rotating the handle screw.

The interior cavity 524 may hold a dispensing fluid 526 that is to be dispensed from the device 500. In such embodiments, the top portion 512 of the handle 510 may be rotated, causing the handle piston 552 to move toward the applicator 504 and reducing the volume of the interior cavity 524. As the volume in the interior cavity 524 decreases, the pressure within the interior cavity may increase, forcing the dispensing fluid 526 out of the interior cavity 524 through the dispensing orifice 518 in the applicator 504. The interior walls 544 of the shell 502 may allow the handle piston 552 to extend downward past the handle cavity opening 548, allowing additional fluid 526 to be expelled from the orifice 518.

In some embodiments, the top portion 512 of the handle 510 may include a ratchet system so as to prevent the top portion from involuntarily reversing rotation. When the interior cavity 524 is empty or if a user would like to refill the interior cavity, the handle 510 may be removed from the shell 502 and additional fluid may be introduced to the interior cavity 524 through the handle bore 540.

Figure 11:
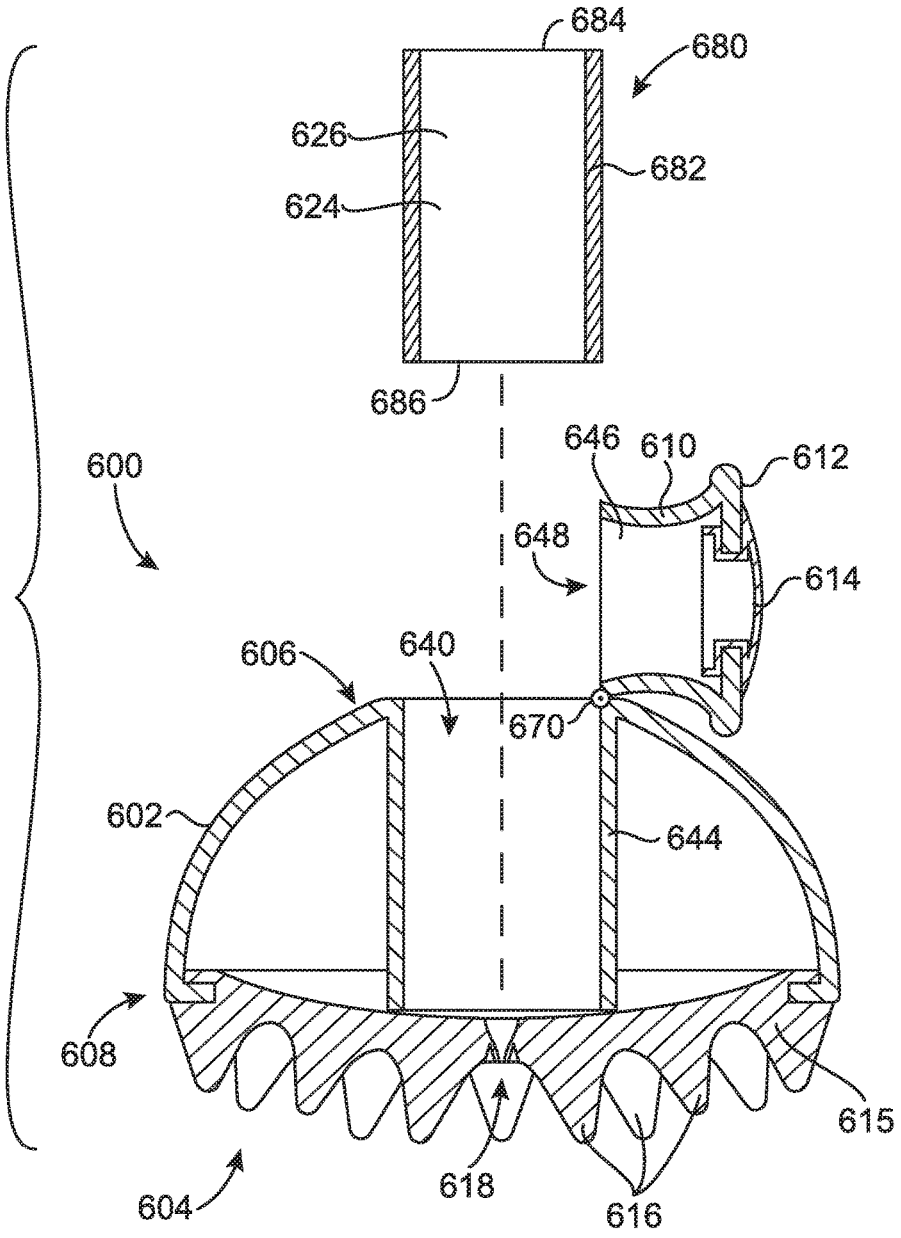
FIG. 11 is an exploded cross-sectional front view of another embodiment of a fluid dispenser and applicator in accordance with the disclosure in a first position.
Figure 12:
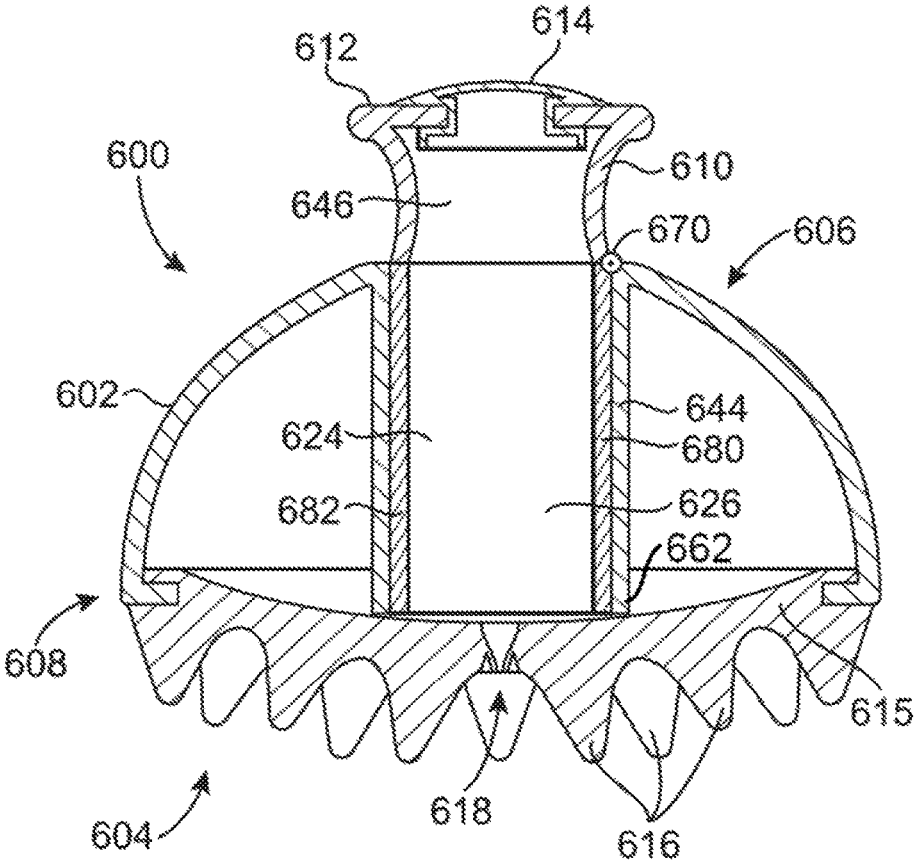
FIG. 12 is a cross-sectional front view of the fluid dispenser and applicator of FIG. 11 in a second position.

FIGS. 11 and 12 are cross-sectional views of another embodiment of a fluid dispenser, applicator, and massage device 600. Similar to the device 500 of FIG. 10, the device 600 may include a shell 602 with a handle portion 606 and an applicator portion 608, with a cartridge bore 640 formed into the handle portion 606 of the shell. The device 600 may also include an applicator 604 connected to the applicator portion 608 of the shell 602. The applicator 604 may include a plurality of nodules 616 and one or more dispensing orifices 618. The shell 602 of device 600 may also include interior walls 644 of the cartridge bore 640 extending substantially all the way to the base portion 615 of the applicator 604. In some embodiments, distal ends 662 of the interior walls 644 may be adhered or otherwise connected to the base portion 615 of the applicator 604 to create a substantially fluid impermeable seal.

A handle 610 may be removably connected to the handle portion 606 of the shell 602 so as to occlude the cartridge bore 640. In some embodiments, the handle 610 may be pivotally connected to the handle portion 606 with a hinge 670 substantially adjacent the cartridge bore 640. In such embodiments, the handle 610 may pivot so as to selectively cover the cartridge bore. For example, FIG. 11 shows the handle 610 pivoted so as to allow access to the cartridge bore 640, and FIG. 12 shows the handle in place covering the cartridge bore 640. It is contemplated that other suitable attachment mechanisms may be used to removably connect the handle 610 to the shell 602. The handle 610 may be locked in place in any suitable way familiar to those skilled in the art and may allow for a substantially fluid impermeable seal.

The device 600 may also include one or more replaceable cartridges 680 that may selectively fit within the cartridge bore 640. In some embodiments, each cartridge 680 may be substantially cylindrical and may include substantially cylindrical cartridge walls 682; however, those skilled in the art would recognize that the cartridges may be other shapes, such as cubes or other prisms. The cartridges 680 may also include removable end coverings 684, 686 on opposite ends of the cartridge walls 682. An interior cavity 624 may be formed within the cartridge 680 between the cartridge walls 682 and the end coverings 684, 686. In some embodiments, the end covering 686 may be removed from the cartridge 680, and the cartridge may be inserted into the cartridge bore 640 with the handle 610 in an open position. Once the cartridge 680 has been inserted into the cartridge bore 640, the other end covering 684 may be removed from the cartridge 680, exposing the fluid 626 within the cartridge to the atmosphere on one end and to the dispensing orifice 618 on the opposite end.

In some embodiments, the handle 610 may include a handle cavity 646 with a handle cavity opening 648 opposite a top portion 612 of the handle 610. The top portion 612 of the handle 610 may include a dispensing trigger 614. In such embodiments, the dispensing trigger 614 may be pressed or otherwise engaged to activate the dispensing of fluid from the within the cartridge and out of the applicator 604. Some embodiments may not include a dispensing trigger at all, and instead dispense fluid via gravity or another triggering mechanism.

When the handle 610 is in place over the cartridge 680 within the cartridge bore, such as shown in FIG. 12, the handle cavity 646 may fluidly communicate with the interior cavity 624 of the cartridge to form a single cavity. In such embodiments, upon activation of the dispensing trigger 314, air from the atmosphere may be introduced into the interior cavity 324, causing the pressure within the interior cavity to increase. In such embodiments, the dispensing trigger 314 may include at least one valve that operates to pump air into the interior cavity 324 upon being compressed by a user. As the pressure within the interior cavity 624 increases from the introduction of air, the dispensing fluid 626 may be forced out of the interior cavity 624 through the dispensing orifice 618 in the applicator 604. When the interior cavity 624 is empty, the empty cartridge 680 may be removed from the cartridge bore 640 and replace with a new cartridge.

Hinge and Lock

Figure 13:
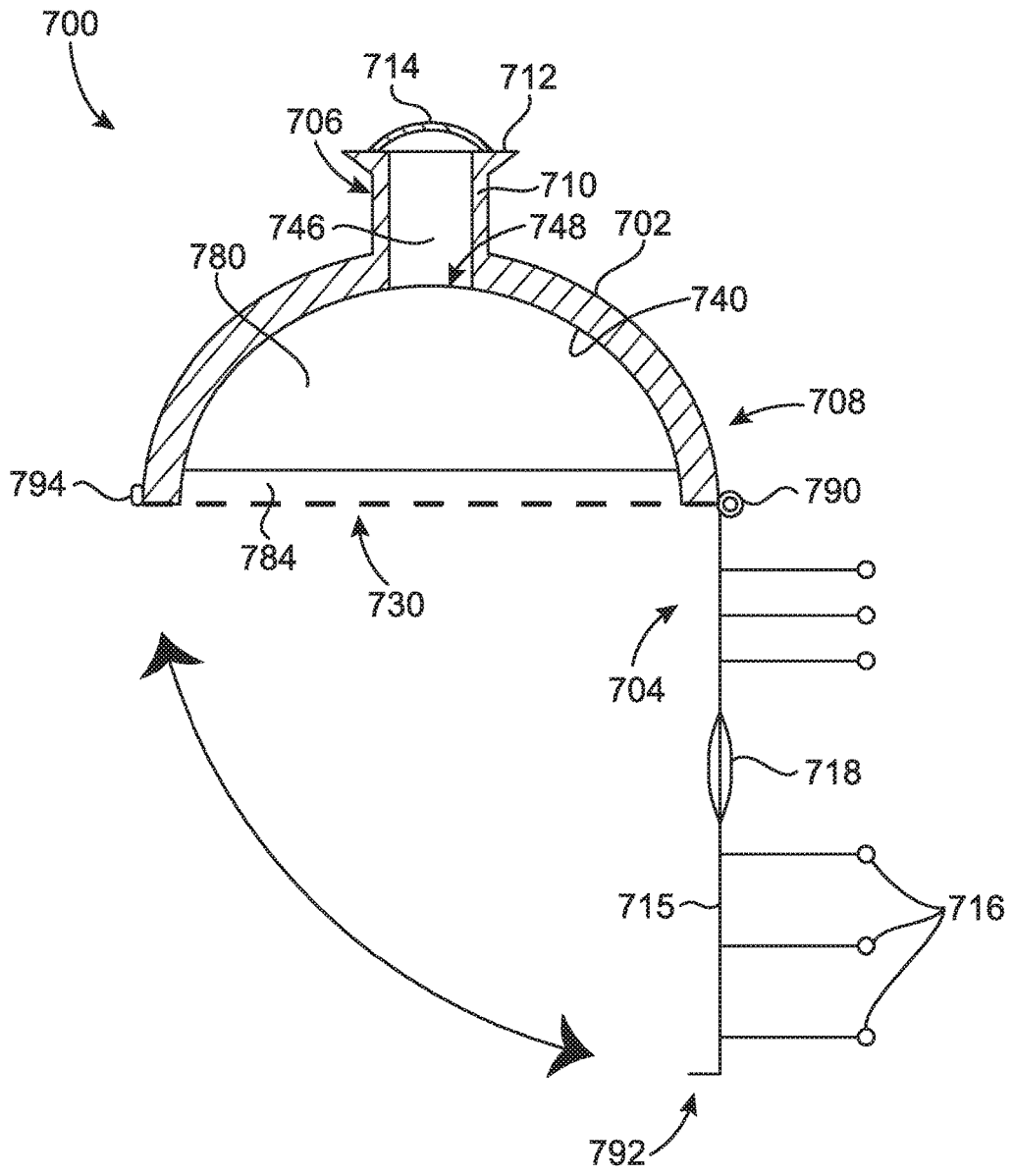
FIG. 13 is a cross-sectional front view of another embodiment of a fluid dispenser and applicator in accordance with the disclosure in an open position.

FIG. 13 is a cross-sectional view of another embodiment of a fluid dispenser, applicator, and massage device 700. The device 700 may include a shell 702 with a handle portion 706 and an applicator portion 708. The device 700 may include a cartridge cavity 740 formed into the shell 702. The device 700 may also include an applicator 704 pivotally connected to the applicator portion 708 of the shell 702 with a hinge 790 at one end and a latch 792 on another end. In some embodiments, the latch 782 may engage with a latch protrusion 794 on the applicator portion 708 of the shell that may secure the applicator 708 to the shell 702. In some embodiments, the applicator 704 may instead be press fit or snap fit into the applicator portion 708 of the shell 702. In such embodiments, the applicator 704 may pivot between a closed position in which substantially the entire perimeter of the applicator 704 may engage the applicator portion 708 of the shell 702, and an open position, as illustrated in FIG. 13. In the open position, the cartridge cavity 740 may be accessible through an applicator orifice 730.

The applicator 704 may include a plurality of nodules 716 and one or more dispensing orifices 718. In some embodiments, the dispensing orifices 718 may be on the base portion 715 of the applicator 704, on the nodules 716 themselves, or a combination of both the nodules and the base portion. In embodiments in which include dispending orifices 718 in the nodules 716, the base portion 715 may include orifices that fluidly communicate with the dispensing orifices in the nodules through the nodules to allow the fluid into the nodules for dispensing.

The device 700 may also include one or more replaceable fluid-filled cartridges 780 that may selectively fit within the cartridge cavity 740. In some embodiments, the cartridge 780 may be shaped to fit any contours of the shell 702, or may be shaped in other suitable ways. In some embodiments, the cartridge 780 may be made of a rigid material. In some embodiments, the cartridge may be made of a flexible and deformable material that may conform to the inner walls of the cartridge cavity 740. In some embodiments, the cartridge 780 may include at least one end covering 784. In some embodiments, the end covering 784 may be removed upon the cartridge's 780 installation in the cartridge cavity 740 to allow the fluid contained within the cartridge to flow out through the dispensing orifice 718 when the applicator 704 is in a closed position. In some embodiments, the end covering 784 may be punctured by protrusions mounted on the base portion 715 of the applicator 704 when the applicator is moved into the closed position. In such embodiments, the fluid contained within the cartridge 780 may flow out through the punctured areas. In some embodiments, the end covering 784 may include semi-perforated regions configured to be breached when a the fluid within the cartridge 780 reaches a certain pressure. In such embodiments, the end covering 784 would allow the flow of the fluid contained within the cartridge 780 out through the breached sections of the end covering. In yet other embodiments, fluid may be installed directly into the cartridge cavity 740 without any cartridge at all.

In some embodiments, a handle 710 of the handle portion 706 may include a handle cavity 746 with a handle cavity opening 748 opposite a top portion 712 of the handle 710. The top portion 712 of the handle 710 may include a dispensing trigger 714. In such embodiments, the dispensing trigger 714 may be pressed or otherwise engaged to activate the dispensing of fluid from the within the cartridge 780 and out of the applicator 704. In some embodiments, activation of the dispensing trigger may increase pressure within the handle cavity, which will apply pressure to the cartridge 780. As the cartridge 780 is exposed to increasing pressure as a result of the dispensing trigger's activation, fluid may flow out of the cartridge and through the dispensing orifices 718 in the applicator 704. In some embodiments, the dispensing trigger may be configured to turn in order to apply mechanical pressure to the cartridge 780 via a piston, such as shown in FIGS. 9 and 10. Some embodiments may not include a dispensing trigger at all, and instead dispense fluid via gravity or another triggering mechanism.

Threaded or Snap-Fit Applicator

Figure 14:
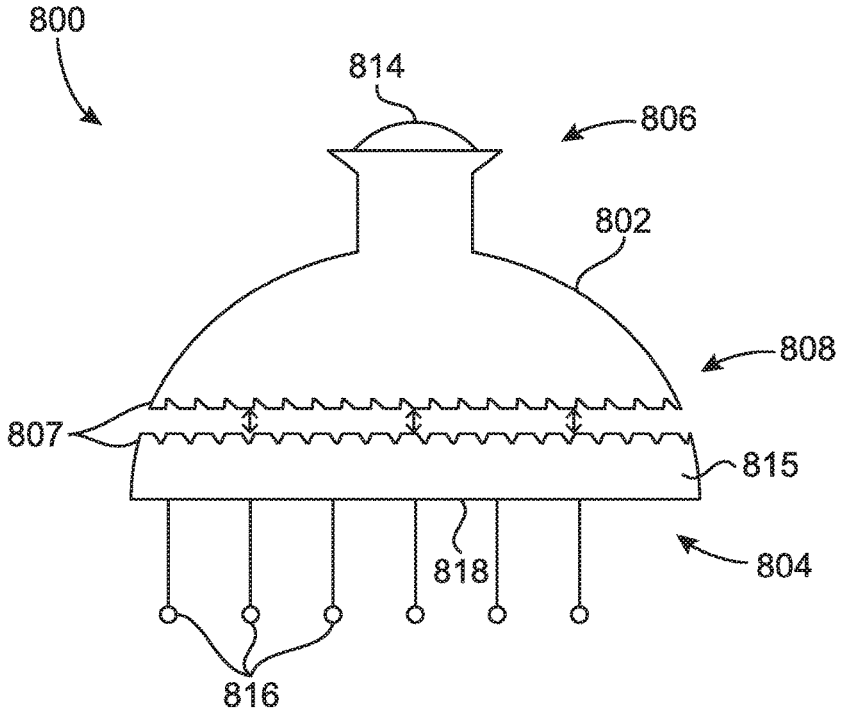
FIG. 14 is an exploded front view of another embodiment of a fluid dispenser and applicator in accordance with the disclosure in an open position.

FIG. 14 is an exploded view of another embodiment of a fluid dispenser, applicator, and massage device 800. The device 800 may include a shell 802 with a handle portion 806 and an applicator portion 808. The device 800 may include an applicator 804 that may connect to the applicator portion 808 of the shell 802 via a threaded connection 807. In some embodiments, the applicator 804 may alternatively be press fit or snap fit into the applicator portion 808 of the shell 802. The applicator 804 may include a plurality of nodules 816 and one or more dispensing orifices 818. In some embodiments, the dispensing orifices 818 may be on the base portion 815 of the applicator 804, on the nodules 816 themselves, or a combination of both the nodules and the base portion. In embodiments in which include dispending orifices 818 in the nodules 816, the base portion 815 may include orifices that fluidly communicate with the dispensing orifices in the nodules through the nodules to allow the fluid into the nodules for dispensing.

The device 800 may have otherwise similar features to the device 700 depicted in FIG. 13, such as one or more cartridges, a cartridge cavity, and a dispensing trigger 814. In some embodiments, as the applicator 804 is twisted onto the shell 802 via the threaded connection 807, the increasing mechanical pressure applied by the applicator against a cartridge disposed within the cartridge cavity may cause fluid to flow out of the cartridge cavity and through the dispensing orifice 818. In other embodiments, pressure may be applied to the cartridge via a dispensing trigger, such as described with respect to the device 700 of FIG. 13, or via a mechanical piston, as described with respect to devices 400 and 500 in FIGS. 9-10.

Replaceable Nodules

Figure 15:
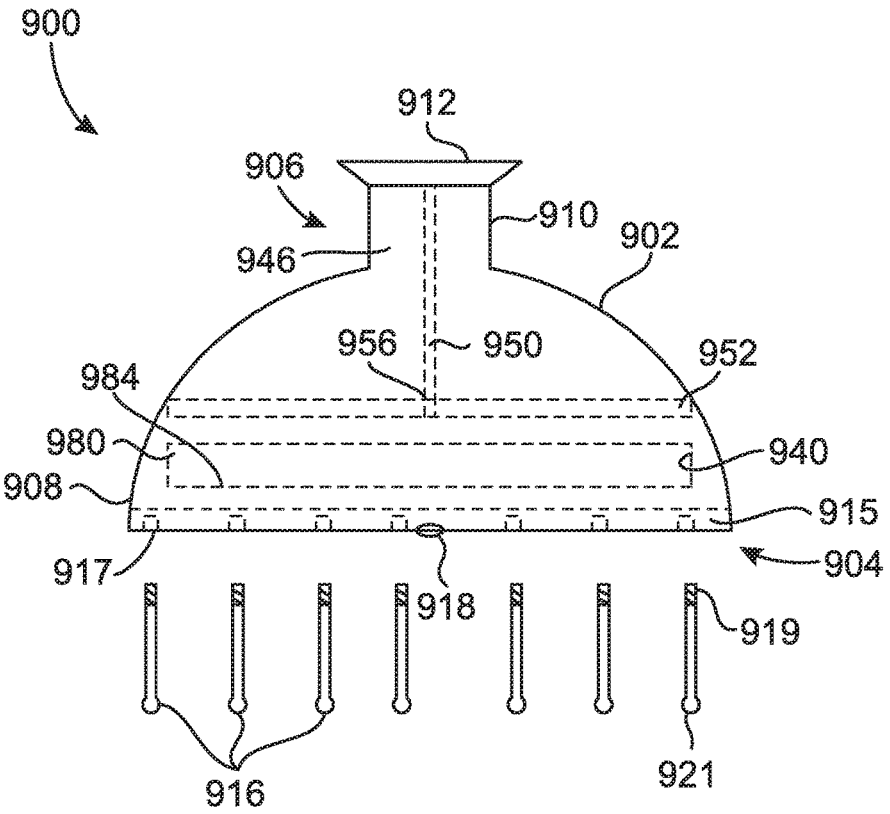
FIG. 15 is a cross-sectional front view of another embodiment of a fluid dispenser and applicator in accordance with the disclosure.

FIG. 15 is a cross-sectional view of another embodiment of a fluid dispenser, applicator, and massage device 900. The device 900 may include a shell 902 with a handle portion 906 and an applicator portion 908. The device 900 may include an applicator 904 that may connect to the applicator portion 908 of the shell 902 via a threaded connection, a hinged connection, a snap-fit connection, a press-fit connection, or any other suitable connection. In any such embodiment, the applicator 904 may move between a closed position in which substantially the entire perimeter of the applicator 904 may engage the applicator portion 908 of the shell 902, and an open position, as illustrated in FIG. 13. In the open position, the cartridge cavity 940 may be accessible through an applicator orifice.

The applicator 904 may include a plurality of nodules 916 and one or more dispensing orifices 918. In some embodiments, the dispensing orifices 918 may be on the base portion 915 of the applicator 904, on the nodules 916 themselves, or a combination of both the nodules and the base portion. In embodiments in which include dispending orifices 918 in the nodules 916, the base portion 915 may include nodule orifices 917 that fluidly communicate with the dispensing orifices in the nodules through the nodules to allow the fluid into the nodules for dispensing.

In some embodiments, the nodules 916 may be removable and replaceable. Such embodiments may allow a user to replace worn or broken nodules with new nodules, or to use nodules having various selected stiffness, materials, lengths, widths, sharpness, or any other characteristic. In some embodiments, a proximate end 919 of each nodule 916 may fit into a corresponding nodule orifice 917 in the base portion 915 of the applicator 904. In some embodiments the nodule orifice 917 and the proximate end 919 of the nodules 916 may engage via a threaded connection, a press-fit connection, or any other suitable removable connection. In some embodiments, the nodule orifice 917 may provide fluid communication between the cartridge cavity 940 and the nodules 916, and in other embodiments the nodule orifices 917 may instead include blind holes in the base portion 915. In some embodiments, the nodules 916 may be hollow. In such embodiments, fluid from within the cartridge cavity 940 may flow through nodule orifices 917 in the base portion 915 of the applicator 904, into the proximate ends 919 of the nodules 916, through the hollow nodules, and be dispensed out dispensing orifices in the distal ends 921 of the nodules. In some embodiments, the dispensing orifices may be located on other portions of the nodules 916. It should be understood that, although removable nodules are described with relation to device 900, such removable nodules 916 may be applicable to other embodiments of the disclosure.

The device 900 may also include one or more replaceable fluid-filled cartridges 980 that may selectively fit within the cartridge cavity 940. In some embodiments, the cartridge 980 may be made of a rigid material. In some embodiments, the cartridge may be made of a flexible and deformable material that may conform to the inner walls of the cartridge cavity 940. In some embodiments, the cartridge 980 may include at least one end covering 984. In some embodiments, the end covering 984 may be removed upon the cartridge's 980 installation in the cartridge cavity 940 to allow the fluid contained within the cartridge to flow out through the dispensing orifice 918 when the applicator 904 is in a closed position. In some embodiments, the end covering 984 may be punctured by protrusions mounted on the base portion 915 of the applicator 904 when the applicator is moved into the closed position. In such embodiments, the fluid contained within the cartridge 980 may flow out through the punctured areas. In some embodiments, the end covering 984 may include semi-perforated regions configured to be breached when a the fluid within the cartridge 980 reaches a certain pressure. In such embodiments, the end covering 984 would allow the flow of the fluid contained within the cartridge 980 out through the breached sections of the end covering. In yet other embodiments, fluid may be installed directly into the cartridge cavity 940 without any cartridge at all.

In some embodiments, a top portion 912 of a handle 910 of the handle portion 906 may include a handle screw 950, which may both be rotatable with respect to the handle 910. The handle screw 950 may pass through a handle cavity 946 and be substantially centered within the handle 910. A handle piston 952 may be substantially cylindrically or disc shaped and be slidably engaged with interior walls of shell 902. The handle screw 950 may pass through a piston orifice 956 of the handle piston 952. In some embodiments, the handle screw 950 may be threaded such that the handle piston 952 may move vertically within the shell's 902 interior when the top portion 912 is rotated, thereby rotating the handle screw. As the handle piston 952 moves downward against the cartridge 980, fluid within the cartridge may be forced out of the cartridge and through the dispensing orifices 918. In embodiments without cartridges, the handle piston 952 may press directly against fluid held within the cartridge cavity 940 or against a deformable membrane spanning the interior of the shell 902 between the handle piston 952 and the cartridge cavity 940.

Split Embodiment

Figure 16:
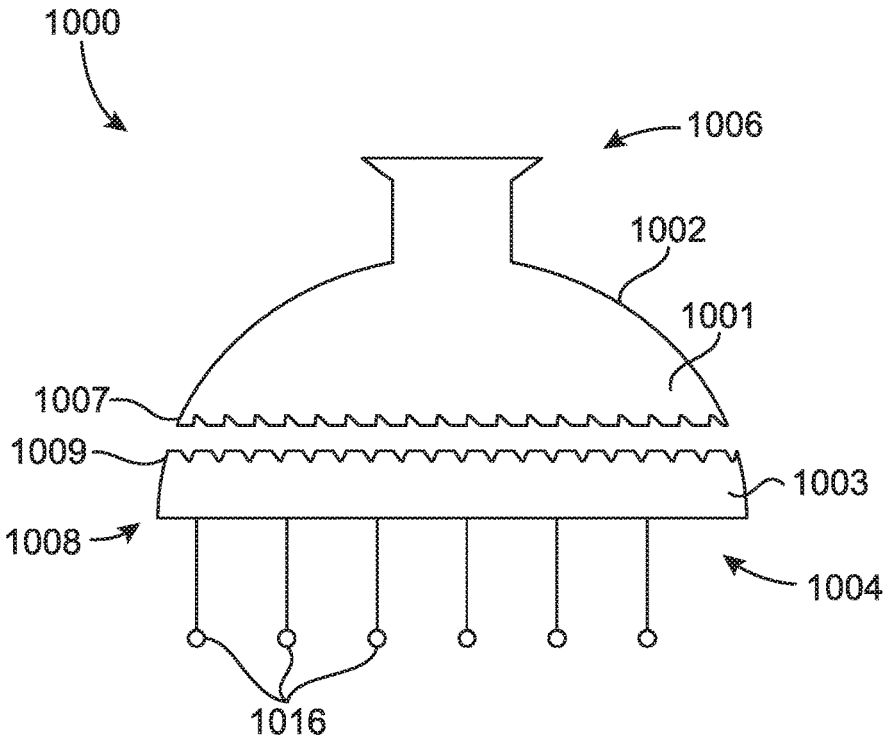
FIG. 16 is an exploded front view of another embodiment of a fluid dispenser and applicator in accordance with the disclosure in an open position.

FIG. 16 is an exploded view of another embodiment of a fluid dispenser, applicator, and massage device 1000. The device 1000 may include a shell 1002 with an upper shell portion 1001 and a lower shell portion 1003. The upper shell portion 1001 may have a handle portion 1006 and an upper connecting portion 1007, and the lower shell portion 1003 may have an applicator portion 1008 with an applicator 1004. The applicator 1004 may include a plurality of nodules 1016 and one or more dispensing orifices 1018. The upper and lower shell portions 1001 and 1003 may connect to one another via a threaded connection, a hinged connection, a snap-fit connection, a press-fit connection, locks, seals, or any other suitable connection allowing for selective movement between an open and closed position. In the open position, fluid or fluid-filled cartridges may be introduced into the interior of the shell 1002 in a manner consistent with the teachings of this disclosure. In the closed position, fluid may be dispensed from the device 1000 in any of the manners contemplated through this disclosure in the various embodiments disclosed herein and illustrated in FIGS. 1-15.

The foregoing description and drawings merely explain and illustrate the invention and the invention is not limited thereto. While the specification is described in relation to certain implementation or embodiments, many details are set forth for the purpose of illustration. Thus, the foregoing merely illustrates the principles of the invention. For example, the invention may have other specific forms without departing from its spirit or essential characteristic. The described arrangements are illustrative and not restrictive. To those skilled in the art, the invention is susceptible to additional implementations or embodiments and certain of these details described in this application may be varied considerably without departing from the basic principles of the invention. It will thus be appreciated that those skilled in the art will be able to devise various arrangements which, although not explicitly described or shown herein, embody the principles of the invention and, thus, within its scope and spirit.

What is claimed is:

1. A fluid dispenser comprising:

a shell including a handle portion and an applicator portion opposite the handle portion, a cartridge bore being formed in the shell between the applicator portion and the handle portion;

a handle connected to the handle portion of the shell, the handle having a width that is smaller than a width of the shell at the applicator portion; and an applicator connected to the applicator portion of the shell, the applicator including a base portion, a plurality of nodules extending from the base portion away from the handle portion of the shell, and at least one dispensing orifice, wherein the applicator occludes the cartridge bore;

a cartridge;

wherein the cartridge bore is configured to receive the cartridge, and wherein the at least one dispensing orifice provides fluid communication into the cartridge bore through the applicator.

2. The fluid dispenser of claim 1, wherein the at least one dispensing orifice is formed through the base portion of the applicator.

3. The fluid dispenser of claim 1, wherein the handle includes a dispensing trigger configured to introduce air into the cartridge bore upon activation.

4. The fluid dispenser of claim 1, wherein the handle includes a dispensing trigger and an inflatable pouch disposed within a handle cavity formed in the handle in fluid communication with the cartridge bore, and where the dispensing trigger is configured to introduce air into the inflatable pouch upon activation of the dispensing trigger, thereby increasing pressure within the cartridge bore.

5. The fluid dispenser of claim 1, wherein the at least one dispensing orifice is configured to prevent passage of a fluid under a predetermined pressure, and allow passage of the fluid above the predetermined pressure.

6. The fluid dispenser of claim 1, wherein the at least one dispensing orifice is formed in at least one of the plurality of nodules.

7. The fluid dispenser of claim 1, wherein the cartridge further comprises a fluid that is in fluid communication with the at least one dispensing orifice.

8. The fluid dispenser of claim 1, wherein the applicator is made from flexible polymer material.

9. A fluid dispenser comprising:

a shell including a handle portion and an applicator portion opposite the handle portion, a cartridge bore being formed within the shell between the handle portion and the applicator portion;

an applicator connected to the applicator portion of the shell so as to occlude the cartridge bore, the applicator including a base portion, a plurality of nodules extending from the base portion away from the handle portion, and at least one dispensing orifice formed through the applicator;

a handle connected to the handle portion of the shell, a handle cavity being formed through the handle and in fluid communication with the cartridge bore, the handle cavity having a width that is smaller than a width of the cartridge bore; and a fluid-filled cartridge received within the cartridge bore, the at least one dispensing orifice being configured to provide fluid communication through the applicator to the fluid-filled cartridge.

10. The fluid dispenser of claim 9, wherein the handle further includes a dispensing trigger configured to increase a pressure within the cartridge bore so as to dispense fluid from the fluid-filled cartridge through the at least one dispensing orifice upon activation of the dispensing trigger.

11. The fluid dispenser of claim 10, wherein the dispensing trigger includes a pump mechanism configured to introduce air into the handle cavity.

12. The fluid dispenser of claim 10, wherein the dispensing trigger includes a handle piston configured to decrease the volume within the handle cavity, thereby increasing a pressure within the cartridge cavity bore and the handle cavity upon activation of the dispensing trigger.

13. The fluid dispenser of claim 12, wherein the dispensing trigger is activated by rotating a portion of the handle.

14. The fluid dispenser of claim 10, wherein the at least one dispensing orifice is configured to prevent passage of a fluid under a predetermined pressure, and allow passage of the fluid above the predetermined pressure.

15. A fluid dispenser comprising:

a shell including a handle portion and an applicator portion opposite the handle portion, an opening being formed in the handle portion, an applicator orifice being formed in the applicator portion, and a cartridge bore formed within the shell between the opening and the applicator orifice;

an applicator connected to the applicator portion of the shell so as to occlude the applicator orifice, the applicator including a base portion, a plurality of nodules extending from the base portion away from the handle portion, and at least one dispensing orifice formed through the applicator and in fluid communication with the cartridge bore;

a handle connected to the handle portion of the shell, the handle having a width that is smaller than a width of the shell at the applicator portion; and a cartridge configured to be received within the cartridge bore, the cartridge including a fluid;

wherein the fluid included within the cartridge is in fluid communication with the at least one dispensing orifice when the cartridge is within the cartridge bore.

16. The fluid dispenser of claim 15, wherein the handle further includes a dispensing trigger configured to increase a pressure within the cartridge bore so as to dispense fluid from the cartridge through the at least one dispensing orifice upon activation of the dispensing trigger.

17. The fluid dispenser of claim 16, wherein the dispensing trigger includes a pump mechanism configured to introduce air into the cartridge bore.

18. The fluid dispenser of claim 16, wherein the dispensing trigger includes a handle piston configured to decrease the volume within the cartridge bore, thereby increasing a pressure within the cartridge bore upon activation of the dispensing trigger.

19. The fluid dispenser of claim 15, wherein the at least one dispensing orifice is configured to prevent passage of a fluid under a predetermined pressure, and allow passage of the fluid above the predetermined pressure.

* * * * *